US009801417B2

(12) United States Patent
Li et al.

(10) Patent No.: US 9,801,417 B2
(45) Date of Patent: Oct. 31, 2017

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Laizhi Song, Shenzhen (CN); Jianbing Liao, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 380 days.

(21) Appl. No.: 14/566,702

(22) Filed: Dec. 10, 2014

(65) Prior Publication Data

US 2015/0164146 A1 Jun. 18, 2015

(30) Foreign Application Priority Data

Dec. 13, 2013 (CN) ..... 2013 2 0815564 U

(51) Int. Cl.
*A24F 47/00* (2006.01)
*H05B 3/04* (2006.01)

(52) U.S. Cl.
CPC ..... *A24F 47/008* (2013.01); *H05B 3/04* (2013.01)

(58) Field of Classification Search
CPC ..... A24F 47/00; A61M 15/06
See application file for complete search history.

(56) References Cited

U.S. PATENT DOCUMENTS

2006/0196518 A1* 9/2006 Hon ..... A24F 47/002 131/360
2013/0056013 A1* 3/2013 Terry ..... A24F 47/008 131/328
2013/0333711 A1* 12/2013 Liu ..... A24F 47/008 131/329
2014/0150783 A1* 6/2014 Liu ..... A24F 47/008 128/202.21
2014/0216483 A1* 8/2014 Alima ..... A24F 47/008 131/329

* cited by examiner

*Primary Examiner* — Cynthia Szewczyk
(74) *Attorney, Agent, or Firm* — Cheng-Ju Chiang

(57) ABSTRACT

An exemplary atomizer for an electronic cigarette includes an atomizing sleeve, a liquid chamber sealed in the atomizing sleeve, and an atomizing assembly arranged at a bottom end of the sleeve. The atomizing sleeve defines an air outlet at a top end thereof. The atomizing assembly includes a hollow fixing holder, a transmission component, a seal cover, an elastic element, an air pipe, and a heating component. The seal cover is movable with the transmission component between a first position where a liquid passage is formed between the seal cover and the fixing holder, and a second position where the liquid passage is closed. The elastic element is configured for storing energy when the liquid passage is open, and for driving the transmission component to move downwards and bringing the seal cover to move downwards to close the liquid passage.

10 Claims, 5 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

A typical electronic cigarette includes an atomizer and a battery assembly. The atomizer includes an atomizing sleeve, a liquid reservoir defined in the atomizing sleeve, and a heating component. The liquid reservoir is configured for storing tobacco liquid. The heating component is for heating the tobacco liquid.

However, after the tobacco liquid is injected into the liquid reservoir, if the electronic cigarette is not used for a long time, the tobacco liquid may leak. The heating component is immersed in the tobacco liquid all the time, the heating element may be destroyed, and the tobacco liquid may be polluted.

What is needed, therefore, is an atomizer and an electronic cigarette using same, which can overcome the above shortcomings.

SUMMARY

An exemplary atomizer for an electronic cigarette includes an atomizing sleeve, a liquid chamber sealed in the atomizing sleeve, and an atomizing assembly arranged at a bottom end of the sleeve. The atomizing sleeve defines an air outlet at a top end thereof. The atomizing assembly includes a hollow fixing holder, a transmission component, a seal cover, an elastic element, an air pipe, and a heating component. The seal cover is movable with the transmission component between a first position where a liquid passage is formed between the seal cover and the fixing holder, and a second position where the liquid passage is closed. The elastic element is configured for storing energy when the liquid passage is open, and for driving the transmission component to move downwards and bringing the seal cover to move downwards to close the liquid passage.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below and with references to the drawings.

Figure 1:
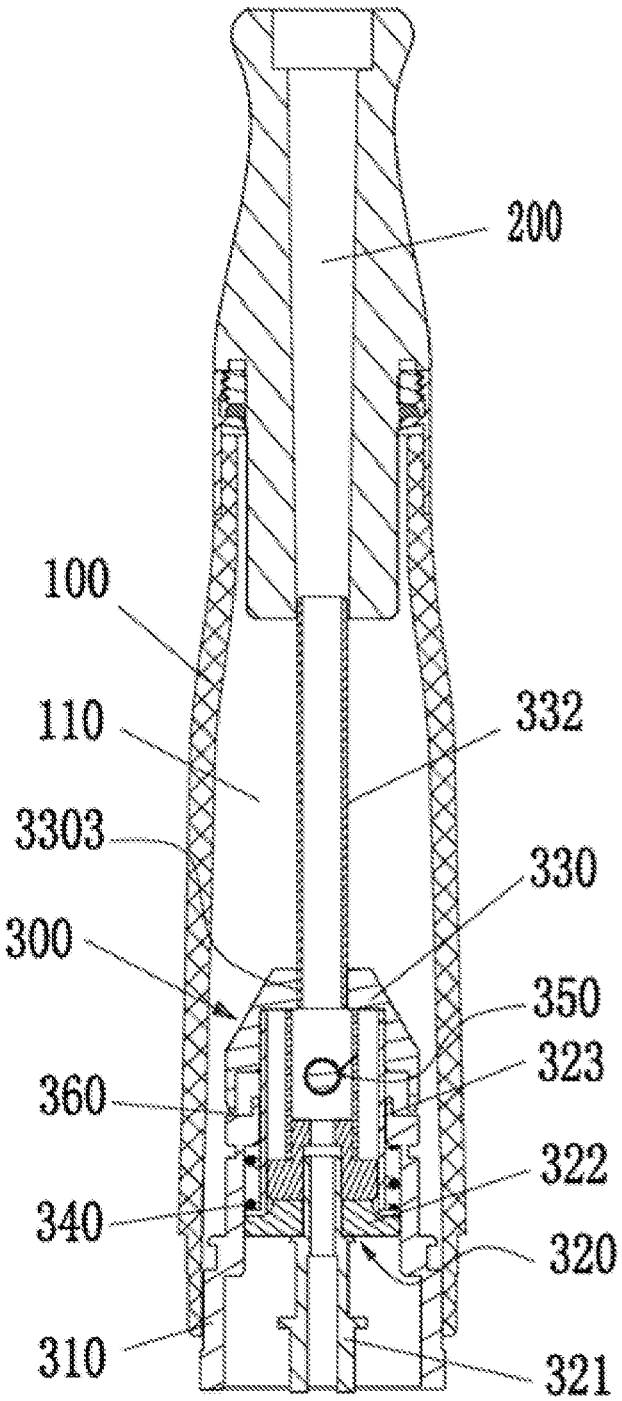
FIG. 1 is a cross-sectional view of an atomizer according to a first embodiment, including a transmission component, a heating component, a seal cover, a bracket, a fixing holder, and an elastic element.

Referring to FIG. 1, an atomizer for an electronic cigarette includes an atomizing sleeve 100 and a liquid chamber 110 defined in the atomizing sleeve 100. The atomizing sleeve 100 includes a top end and a bottom end, an air outlet 200 is defined in the top end, and an atomizing assembly 300 is arranged at the bottom end. The atomizing assembly 300 includes a fixing holder 310, a transmission component 320, a seal cover 330, an elastic element 340, a heating component 350, and an air pipe 332. The fixing holder 310 is fixedly connected to the atomizing sleeve 100. The transmission component 320 extends through the fixing holder 310, and is movable along an axial direction of the transmission component 320. The seal cover 330 is connected to the transmission component 320. The elastic element 340 is sandwiched between the transmission component 320 and the fixing holder 310. The heating component 350 is configured (i.e., structured and arranged) for absorbing tobacco liquid and heating the absorbed tobacco liquid to vaporize. The air pipe 332 extends from the seal cover 330 to the air outlet 200. The seal cover 330 is movably engaged with a top part of the fixing holder 310 to selectively form a liquid passage 360. The seal cover 330 moves upwards or downwards together with the transmission component 320 to open or close a liquid passage 360. In the present embodiment, the elastic element 340 is a spring. The spring is compressed when the transmission component 320 drives the seal cover 330 to move upwards. The spring stores energy and generates an elastic force, which pushes the transmission component 320 to move downwards, thus bringing the seal cover 330 to move downwards to close the liquid passage 360. Therefore, when the atomizer is not in use, the tobacco liquid cannot reach the atomizing assembly 300. In the present embodiment, the seal cover 330 defines a vent hole 3303 at a top portion. The air pipe 332 is coupled to the vent hole 3303 by interference fit, so that the air pipe 332 is fixedly connected with the seal cover 330. It is to be understood that in other embodiments, the air pipe 332 and the seal cover 330 may be integrally formed.

Figure 2:
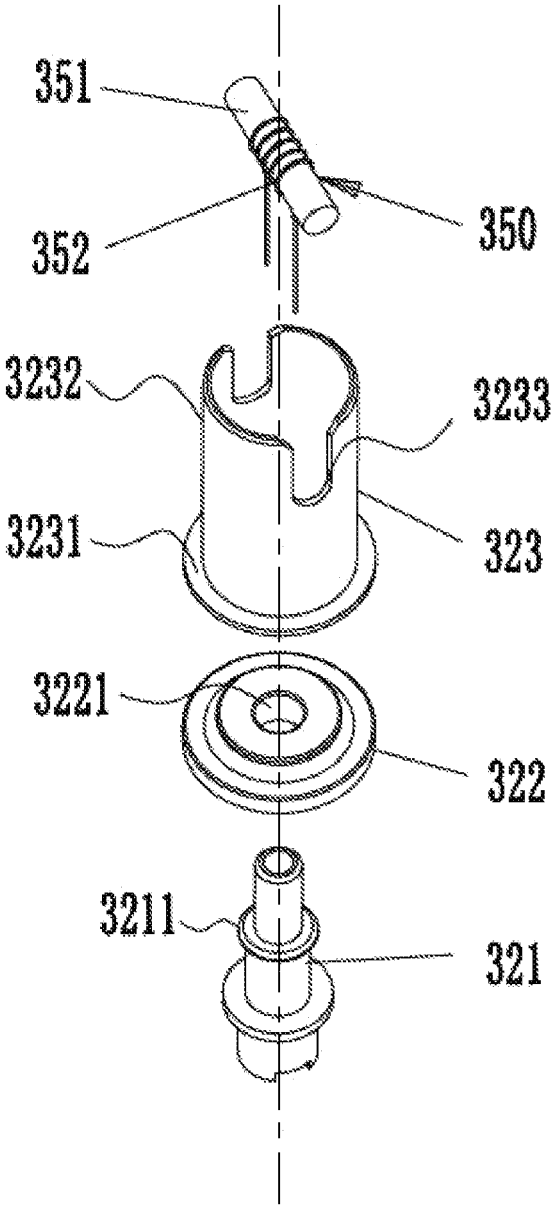
FIG. 2 is an exploded perspective view of the transmission component and the heating component of FIG. 1.
Figure 3:
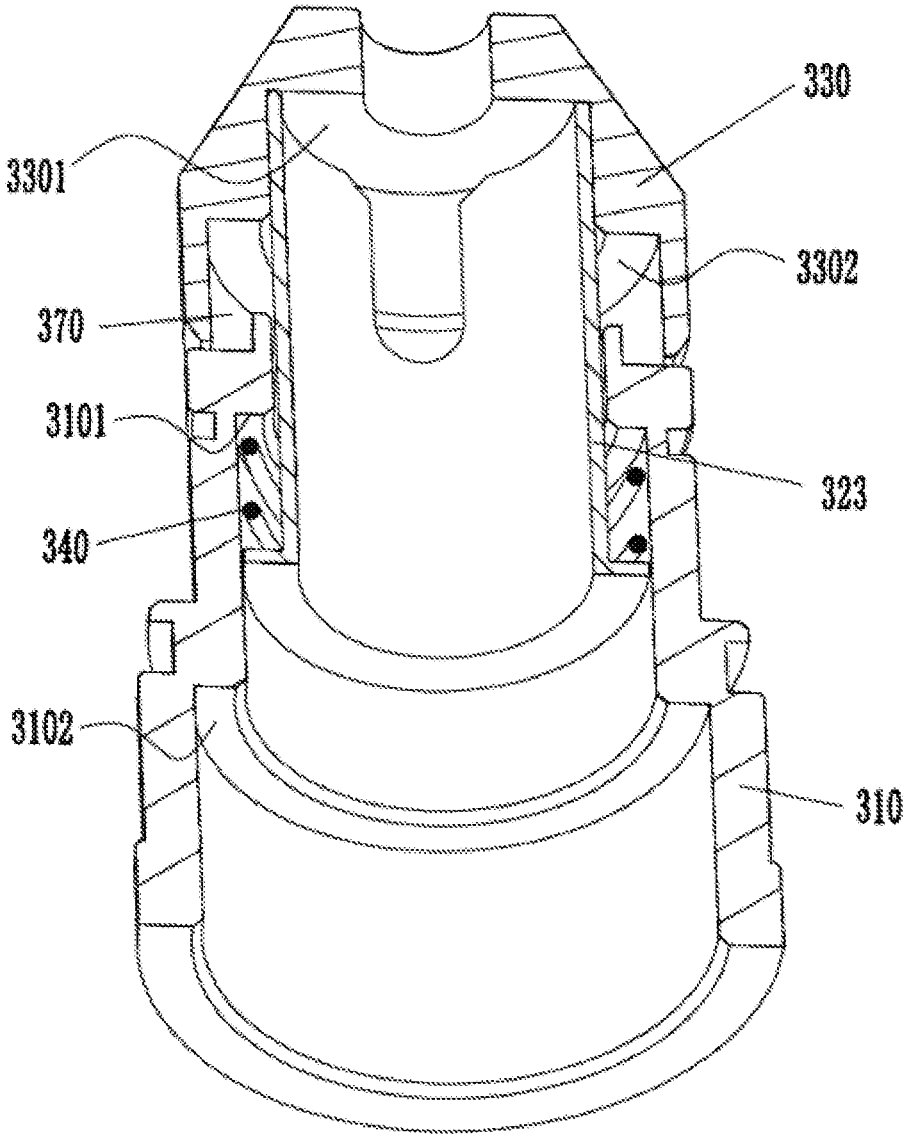
FIG. 3 is a perspective cutaway view of the seal cover, the bracket, the fixing holder, and the elastic element when assembled.

Referring to FIGS. 2-3, the transmission component 320 includes a tubular electrode 321, an insulated piece 322, and a bracket 323. The transmission component 320 is configured for transmitting an upward pushing force exerted on the tubular electrode 321, and a downward elastic force exerted on the bracket 323. The tubular electrode 321 includes a protruding stage 3211 on an outer surface. The insulated piece 322 defines a through hole 3221. The tubular electrode 321 passes the through hole 3221, and the insulated piece 322 rests on the protruding stage 3211. The insulated piece 322 is configured for holding the bracket 323 and keeps the tubular electrode 321 insulated from the bracket 323. The bracket 323 includes a supporting part 3231 at a top part and an assembly part 3232 at a bottom part. The supporting part 3231 is adapted for supporting the elastic element 340. The assembly part 3232 is configured for engaging with the heating component 350. The bracket 323 is substantially tubular. The bracket 323 and the fixing holder 310 cooperatively clamp the elastic element 340 therebetween. The fixing holder 310 includes a step portion 3101 protruding inward. Two ends of the elastic element 340 are in contact with the supporting part 3231 and the step portion 3101, respectively. The seal cover 330 includes a first step hole 3301 and a second step hole 3302. The assembly part 3232 is fixedly engaged in the first step hole 3301 by interference fit. An inner diameter of the second step hole 3302 is larger than that of the first step hole 3301. An inner wall of the seal cover 330 and an outer wall of the bracket 323 cooperatively define a receiving space 370 for receiving the tobacco liquid, which flows into the atomizing assembly 300 via the liquid passage 360. The assembly part 3232 defines a pair of grooves 3233 at a top portion, and the heating component 350 is engaged in the grooves 3233. The heating component 350 includes a liquid conducting element 351 and a heating element 352. The liquid conducting element 351 is engaged in the grooves 3233. Two ends of the liquid conducting element 351 extend to the receiving space 370, so that the liquid conducting element 351 absorbs the tobacco liquid in the receiving space 370. The tobacco liquid absorbed in the liquid conducting element 351 is heated by the heating element 352 to form aerosol. The aerosol passes through the air pipe 332, goes out of the air outlet 200, and then reaches mouth of a user of the atomizer.

Figure 4:
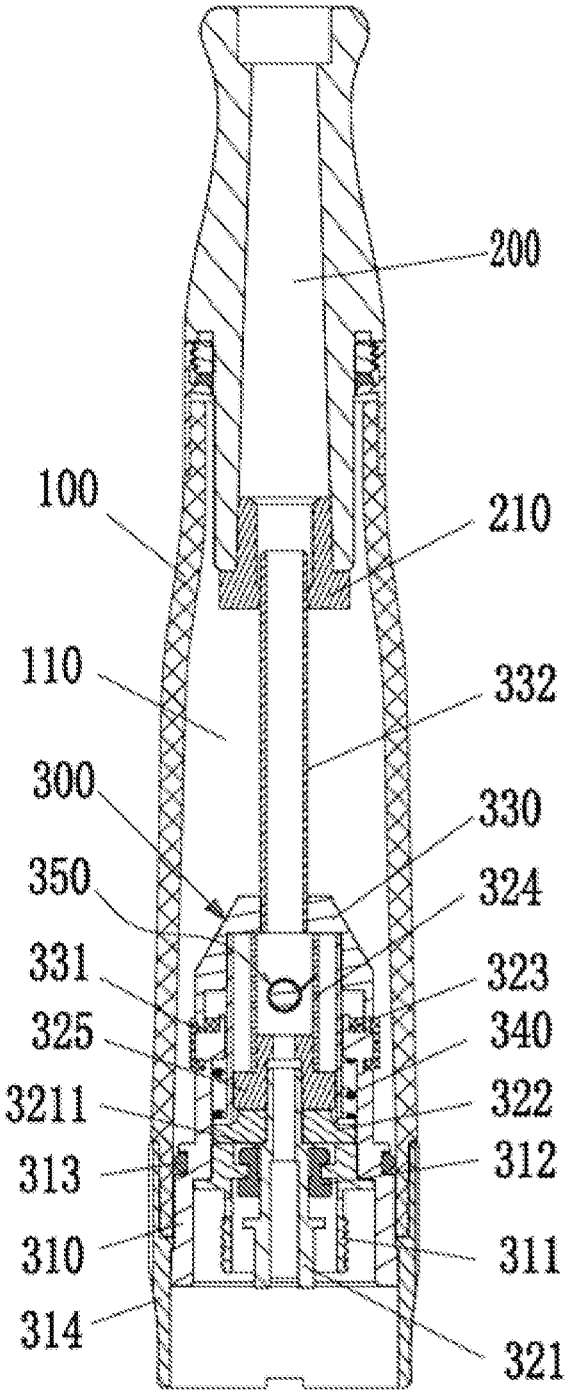
FIG. 4 is a cross-sectional view of an atomizer according to a second embodiment.

Referring to FIG. 4, a flexible seal element 331 may be arranged between the fixing holder 310 and the seal cover 330, thus improving sealing effect between the seal cover and the fixing holder 310 when the liquid passage 360 is closed. The flexible seal element 331 nests the fixing holder 310.

Further, a hollow liquid blocking component 324 may be arranged in the bracket 323. The liquid conducting element 351 is supported by the liquid blocking component 324. The air pipe 332 communicates with the liquid blocking component 324. The liquid conducting element 351 may be made of glass fiber core. The heating element 352 is wound around the liquid conducting element 351. The liquid blocking component 324 may be a glass fiber tube. The heating component 352 is received in the liquid blocking component 324. A fixing sleeve 325 is arranged at a bottom part of the liquid blocking component 324. The fixing sleeve 325 is held against the insulated piece 322. The liquid blocking component 324 does not absorb tobacco liquid, and can prevent the liquid conducting element 351 from absorbing too much tobacco liquid.

Even further, a metallic sleeve 311 may be arranged in the fixing holder 310 as a connector, an insulated ring 312 is sandwiched between the metallic sleeve 311 and the tubular electrode 321. The insulated ring 312 is fixed in the metallic sleeve 311. The tubular electrode 321 passes through the insulated ring 312, and is movable upwards or downwards relative to the insulated ring 312.

Furthermore, a seal ring 313 may be arranged between the fixing holder 310 and the atomizing sleeve, avoiding leakage of the tobacco liquid in the liquid chamber 110 from a gap between the fixing holder 310 and the atomizing sleeve 100.

In other embodiments, the atomizer may further includes a fastening sleeve 314 wrapped around the fixing holder 310. A bottom part of the atomizing sleeve 100 is clamped between the fastening sleeve 314 and the fixing holder 310. The fastening sleeve 314 makes the fixing holder 310 and the atomizing sleeve 100 connect firmly.

In addition, a sealing plug 210 may be arranged between the air outlet 200 and the air pipe 332. The sealing plug 210 defines a hole, and the air pipe 332 inserts into the hole. The air pipe 332 is capable of sliding along an axis thereof relative to the sealing plug 210. The sealing plug 210 is flexible, and engaged with the air pipe 332 by interference fit, thus preventing tobacco liquid from leaking.

Figure 5:
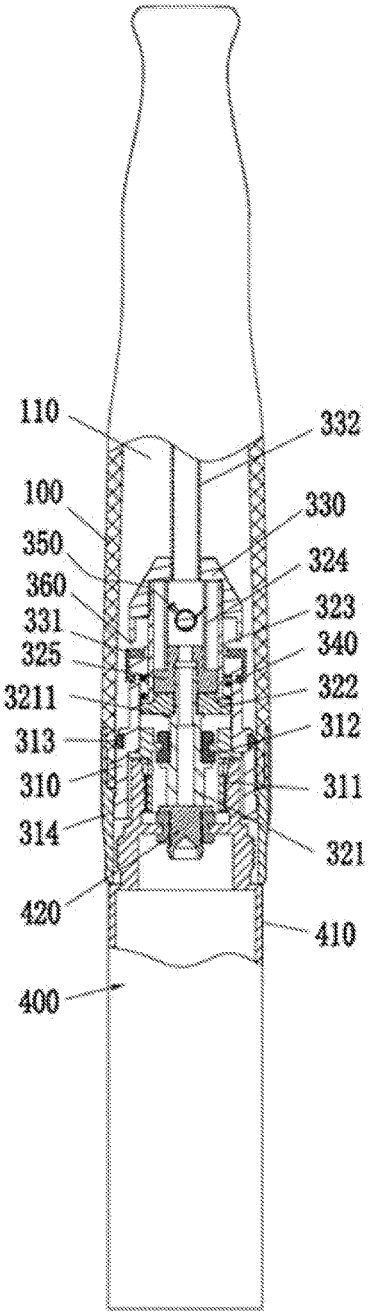
FIG. 5 is a partially cutaway view of an atomizer according to a third embodiment.

Referring to FIG. 5, an electronic cigarette is shown. The electronic cigarette includes a battery assembly 400, and the atomizer of the second embodiment. The battery assembly 400 includes a casing 410, and a pushing element 420 disposed at one end of the casing 410. The tubular electrode 321 is held against the pushing element 420. When the atomizer is coupled to the battery assembly 400, the pushing element 420 pushes the tubular electrode 321 of the atomizer, the transmission component 320 transmits a pushing force to the seal cover 330, and drives the seal cover 330 upward, thus opening the liquid passage 360 between the seal cover 330 and the fixing holder 310. In this position, the heating component 350 absorbs the tobacco liquid and heats the tobacco liquid. When the electronic cigarette is not in use, and the battery assembly 400 is detached from the atomizer, the elastic element 340 exerts an elastic force on the transmission component 320, and the transmission component 320 transmits the elastic force. As a result, the liquid passage 360 between the seal cover 330 and the fixing holder 310 is closed, thus preventing the tobacco liquid in the liquid chamber 110 from entering the atomizing assembly 300.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer for an electronic cigarette comprising:

an atomizing sleeve, the atomizing sleeve defining an air outlet at a top end thereof;

a liquid chamber with tobacco liquid stored therein sealed in the atomizing sleeve; and an atomizing assembly arranged at a bottom end of the atomizing sleeve, the atomizing assembly comprising:

a hollow fixing holder fixedly connected the bottom end of the atomizing sleeve;

a transmission component, extending through the fixing holder, and being movable inside the fixing holder along an axial direction of the transmission component relative to the fixing holder;

a seal cover fixedly connected with the transmission component and positioned outside the fixing holder, the seal cover being movable together with the transmission component between a first position where a liquid passage is formed between the seal cover and the fixing holder, and a second position where the liquid passage is closed;

an elastic element sandwiched between the transmission component and the fixing holder, the elastic element being configured for storing energy when the liquid passage is formed in the first position of the seal cover, and configured for driving the transmission component to move from the first position to the second position of the seal cover using the stored energy and bringing the seal cover to move and close the liquid passage in the second position of the seal cover;

an air pipe, a first end of the air pipe being fixedly connected with the seal cover, an opposite second end of the air pipe connectively extending to the air outlet; and a heating component residing between the seal cover and the fixing holder, and having a liquid conducting element and a heating element, the liquid conducting element being configured for absorbing tobacco liquid out of the liquid chamber flowing via and from the liquid passage, the heating element being configured for heating the absorbed tobacco liquid to vaporize.

2. The atomizer according to claim 1, further comprising a flexible seal element arranged between the fixing holder and the seal cover, wherein the flexible seal element nests the fixing holder.

3. The atomizer according to claim 1, wherein the transmission component comprises:

a tubular electrode having a protruding stage on an outer surface;

an insulated piece having a through hole, the tubular electrode extending through the through hole, the insulated piece resting on the protruding stage; and a bracket held to be insulated from the tubular electrode by the insulated piece, the bracket having a supporting part at a top part of the bracket and an assembly part at a bottom part of the bracket, the supporting part being adapted for supporting the elastic element, and the assembly part being configured for engaging with the heating component.

4. The atomizer according to claim 3, wherein the seal cover defines a first step hole and a second step hole, the assembly part of the bracket is fixedly engaged in the first step hole, an inner wall of the second step hole and an outer wall of the bracket cooperatively define a receiving space for receiving the tobacco liquid, which flows into the atomizing assembly via the liquid passage.

5. The atomizer according to claim 3, further comprising a hollow liquid blocking component, wherein the liquid conducting element is supported by the liquid blocking component, and the heating component is received in the liquid blocking component.

6. The atomizer according to claim 3, further comprising a metallic sleeve arranged in the fixing holder, and an insulated ring sandwiched between the metallic sleeve and the tubular electrode.

7. The atomizer according to claim 1, further comprising a seal ring between the fixing holder and the atomizing sleeve.

8. The atomizer according to claim 1, further comprising a fastening sleeve wrapped around the fixing holder, wherein the bottom end of the atomizing sleeve is clamped between the fastening sleeve and the fixing holder.

9. The atomizer according to claim 1, further comprising a sealing plug arranged between the air outlet and the air pipe, wherein the sealing plug defines a hole, the air pipe inserts into the hole, and the air pipe is slidable along an axis thereof relative to the sealing plug.

10. An electronic cigarette, comprising:

an atomizer according to claim 1; and a battery assembly having a casing and a pushing element arranged at one end of the casing, wherein the transmission component is held against the pushing element when the battery assembly is connected with the atomizer.

* * * * *